US007784129B2

(12) United States Patent
Javaruski et al.

(10) Patent No.: US 7,784,129 B2
(45) Date of Patent: Aug. 31, 2010

(54) RECUMBENT THERAPEUTIC MATTRESS SUPPORT

(76) Inventors: Russell Javaruski, 978B Aberdeen Dr., Lakewood, NJ (US) 08701; James Bergdoll, 3 Conscience Cir., Strongs Neck, Setauket, NY (US) 11733; Paul Gurbapri, 188 Candlewood Rd., Bay Shore, NY (US) 11706

( * ) Notice: Subject to any disclaimer, the term of this patent is extended or adjusted under 35 U.S.C. 154(b) by 0 days.

(21) Appl. No.: 12/315,288

(22) Filed: Dec. 3, 2008

(65) Prior Publication Data

US 2009/0144905 A1 Jun. 11, 2009

Related U.S. Application Data

(60) Provisional application No. 61/005,651, filed on Dec. 7, 2007.

(51) Int. Cl.
*A47C 31/00* (2006.01)

(52) U.S. Cl. ..... 5/660; 5/630; 5/632; 5/659; 5/509.1

(58) Field of Classification Search ..... 5/660, 5/659, 731, 737, 727, 705, 691, 482, 509.1, 5/902, 633, 1
See application file for complete search history.

(56) References Cited

U.S. PATENT DOCUMENTS

| | | | | | |
|---|---|---|---|---|---|
| 2,893,164 | A * | 7/1959 | Martin | 5/509.1 |
| 3,389,411 | A * | 6/1968 | Emery | 5/490 |
| 4,193,150 | A * | 3/1980 | Vineberg | 5/632 |
| 4,830,320 | A * | 5/1989 | Bellows | 248/188.2 |
| 5,205,005 | A * | 4/1993 | Merrill et al. | 5/660 |
| 5,448,790 | A * | 9/1995 | Saro et al. | 5/657 |
| 5,615,429 | A * | 4/1997 | Williams | 5/509.1 |
| 5,771,515 | A * | 6/1998 | Carr | 5/660 |
| 6,170,911 | B1 * | 1/2001 | Kassai et al. | 297/250.1 |
| D446,676 | S * | 8/2001 | Mayes | D6/601 |
| 6,378,151 | B1 * | 4/2002 | Lowe | 5/660 |
| 7,328,471 | B1 * | 2/2008 | Stohr | 5/660 |
| 2006/0070185 | A1 * | 4/2006 | Rubio | 5/732 |
| 2006/0179580 | A1 * | 8/2006 | Robertson et al. | 5/730 |
| 2006/0230539 | A1 * | 10/2006 | Goodman | 5/660 |

* cited by examiner

*Primary Examiner*—Peter M Cuomo
*Assistant Examiner*—Brittany M Wilson
(74) *Attorney, Agent, or Firm*—Clifford G. Frayne

(57) ABSTRACT

A recumbent therapeutic mattress support in the form of a plurality of interlocking wedges positionable between the box spring and the mattress of a bed, the user selectively interlocking two or more wedges to achieve the desired therapeutic elevation for either the head, neck and torso, or the legs in order to achieve the desired degree of support, comfort and relief from pain.

4 Claims, 4 Drawing Sheets

RECUMBENT THERAPEUTIC MATTRESS SUPPORT

RELATED APPLICATIONS

Applicants claim the benefit of provisional application Ser. No. 61/005,651, filed Dec. 7, 2007.

BACKGROUND OF THE INVENTION

1. Field of the Invention

The present invention relates to a therapeutic mattress support selectively positionable between the mattress and the box spring, the therapeutic support being selectively adjustable angularly in height in order to provide the desired degree of support, comfort and relief from pain.

2. Description of the Prior Art

Individuals can suffer from a myriad of physical maladies in which a physician often prescribes bed rest and further recommends the elevation of the head, neck and upper torso, or alternatively elevation of the feet or the knees. Still further, oftentimes individuals are cautioned and recommended to recline on their sides for the relief of pain which positioning oftentimes can be assisted by a therapeutic support which provides an elevation against which the individuals upper torso can rest in order to maintain the individual in a comfortable reclining position on their side.

The maladies that such elevation provides relief include apnea, acid reflux, upper and/or lower back pain, neck pain, and circulatory problems, as well as sprains and other joint injuries.

The most common means of providing such elevation is for the individual to obtain additional pillows and position them at a desired location on top of the mattress in order to support the desired portion of the torso or limbs. The use of pillows may provide the desired elevation and result, however, the use of pillows is something which cannot be repetitively positioned so as to provide the exact degree of elevation and the positioning of the torso or limb in order to provide the comfort and relief desired.

Applicant's recumbent therapeutic mattress support provides for a plurality of wedge members which can be interlocked to provide the desired degree of angular elevation and which wedge supports can be selectively positioned between the mattress and the box spring to provide the therapeutic elevation support to the desired portion of the torso or limb, the wedge supports still further are positionable between the mattress and the box spring and are selectively maintained in position so that when the individual leaves the bed and returns to the bed, the elevation support remains constant with respect to the angular elevation and remains constant as to its position so that the individual can return to the exact position which was providing the comfort and relief desired.

OBJECTS OF THE INVENTION

An object of the present invention is to provide for a novel recumbent therapeutic mattress support which allows an individual to selectively position the therapeutic support between the mattress and the box spring in order to provide a desired degree of elevation to the mattress and hence to a body portion of the individual.

Another object of the present invention is to provide for a novel recumbent therapeutic mattress support which comprises a plurality of therapeutic wedges triangular in cross section, which can be interlocked with each other so as to selectively achieve the desired degree of elevation.

A still further object of the present invention is to provide for a novel recumbent therapeutic mattress support in which the therapeutic wedges can be selectively positioned and maintained between the mattress and the box spring support so as to repetitively provide the desired angular elevation at a location desired on the mattress so as to affect the particular body part desired.

A still further object of the present invention is to provide for a novel recumbent therapeutic mattress support in which the various therapeutic wedges can be interlocked for ease of storage when not in use.

A still further object of the present invention is to provide for a novel recumbent therapeutic mattress support which is formed with a non-slip surface which engages the box spring support and prevents the therapeutic wedges from shifting position.

SUMMARY OF THE INVENTION

A recumbent therapeutic mattress support in the form of a plurality of interlocking wedges positionable between the box spring and the mattress of a bed, the user selectively interlocking two or more wedges to achieve the desired therapeutic elevation for either the head, neck and torso, or the legs in order to achieve the desired degree of support, comfort and relief from pain.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
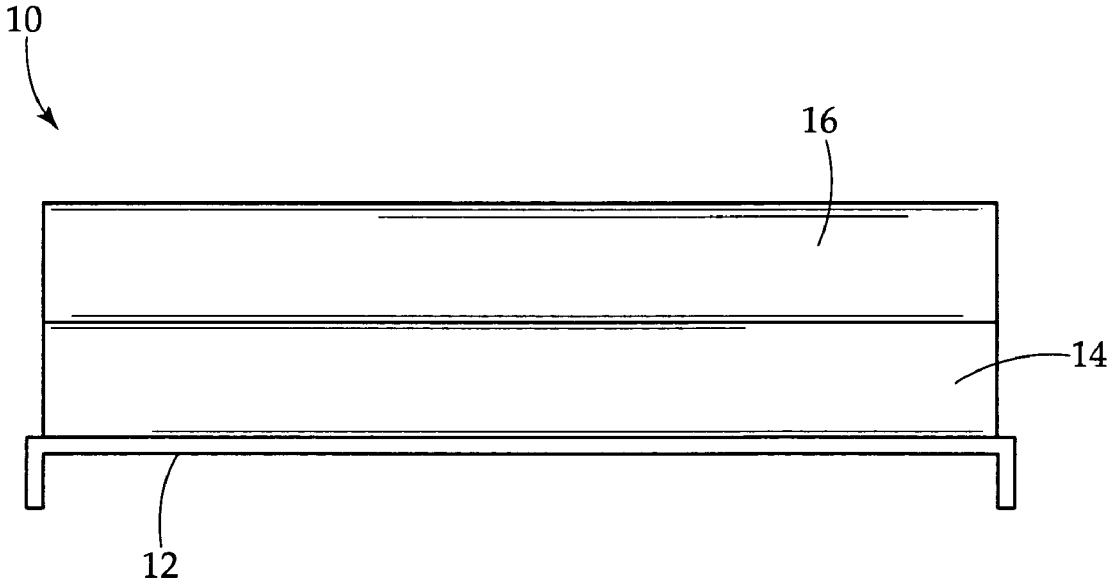
FIG. 1 is a side view of a typical mattress and box spring arrangement for a bed.

FIG. 1 is a side view of a typical bed 10 which is supported by a frame 12 situated on the floor, which frame 12 supports a box spring 14 upon which is supported a mattress 16. Typically, the box spring 14 is more rigid than the mattress 16 with the mattress being constructed of a resilient flexible material so as to provide cushioning.

Figure 2:
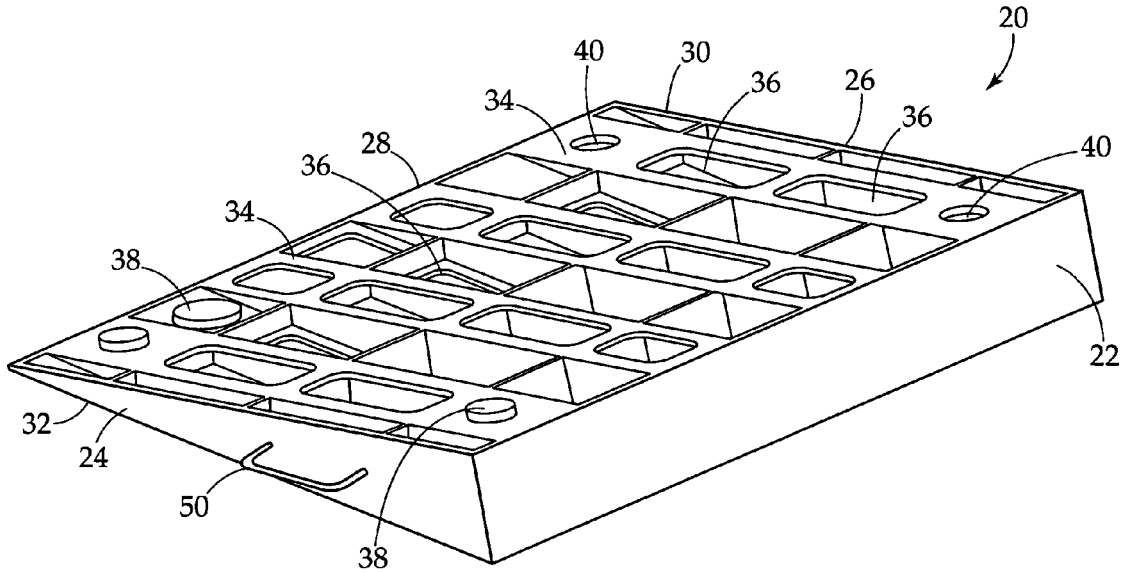
FIG. 2 is an exploded view of a pair of therapeutic mattress supports or wedges of the present invention.
Figure 2:
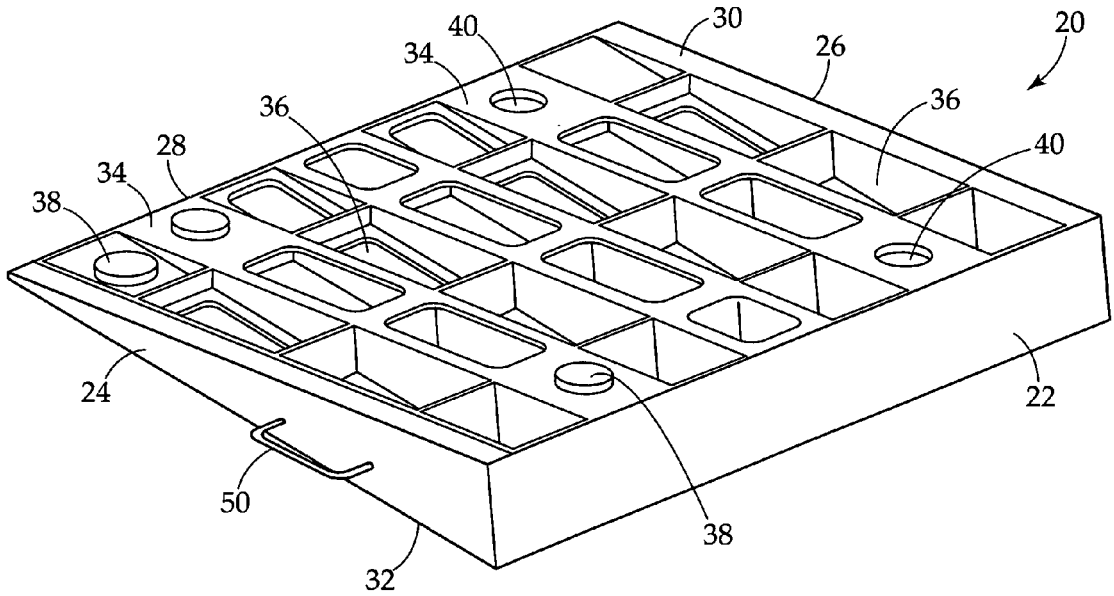

FIG. 2 is an exploded view of a pair of therapeutic mattress support or wedges 20 of the present invention. The therapeutic mattress support or wedges 20 are formed with a vertical end wall 22, rectangular in shape, and two opposing, tapered, triangular side walls 24 and 26. The tapered, triangular side walls 24 and 26 define an opposing edge 28 opposite vertical end wall 22.

The upper and lower surfaces 30 and 32 are of a honeycomb construction having a plurality of ridge members 34 and a plurality of depression members 36 interspersed between said ridge members. This design allows for the therapeutic mattress support or wedges 20 to be molded from one piece high impact plastic or polymer for strength, yet allows the therapeutic mattress supports or wedges 20 to be light weight for easy maneuverability and placement.

Figure 3:
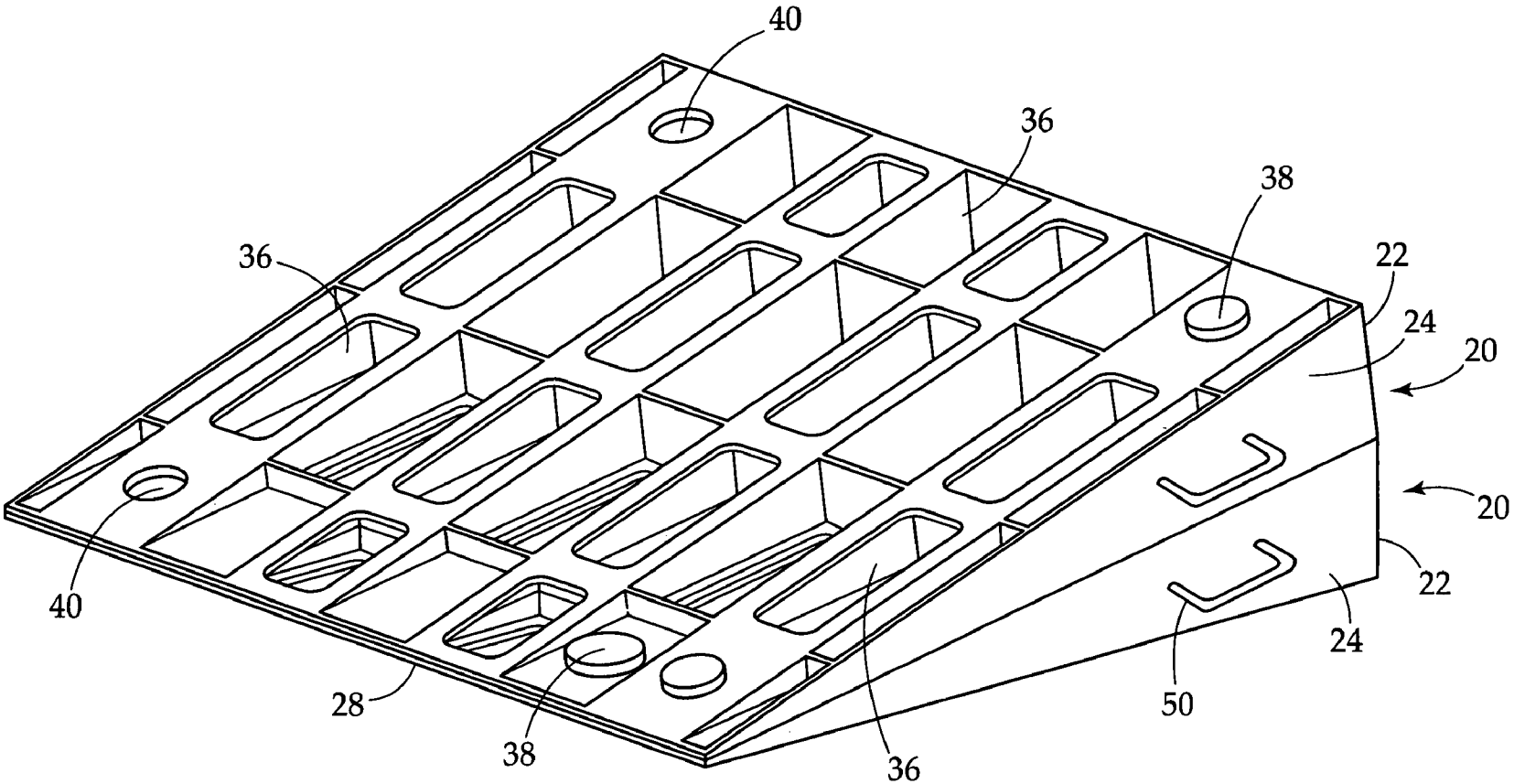
FIG. 3 is a perspective view of a pair of therapeutic mattress supports or wedges of the present invention in an engaged orientation.

Also formed on the upper and lower surfaces 30 and 32 of the therapeutic mattress supports or wedges 20 are a plurality of geometric protrusions 38 which in the therapeutic mattress supports or wedges illustrated in FIG. 2, are circular in shape. Also formed on the upper and lower surfaces 30 and 32 of therapeutic mattress supports or wedges 20 are a plurality of geometric depressions 40 which as illustrated in FIG. 2 are also circular in this embodiment. The plurality of circular protrusions and circular depressions on the lower surface 32 of therapeutic mattress support or wedges 20 are complimentary with geometric depressions or geometric protrusions formed on the upper surface 30 of an adjacent and aligned therapeutic mattress support or wedge 20 such that when placed on top of each other as illustrated in FIG. 3, adjacent therapeutic mattress supports or wedges 20 interlock to form a unitary support or wedge.

In the preferred embodiment, the therapeutic mattress supports or wedges 20 would be approximately 24 inches in width and 24 inches in length with its vertical end wall 22 being approximately 1½ to 2½ inches high. In this configuration, a user could stack a plurality of therapeutic mattress supports or wedges 20 in interlocking relationship with adjacent therapeutic mattress supports or wedges 20 in order to achieve a desired height or angle in order to achieve the desired degree of support, comfort and relief from pain.

Figure 4:
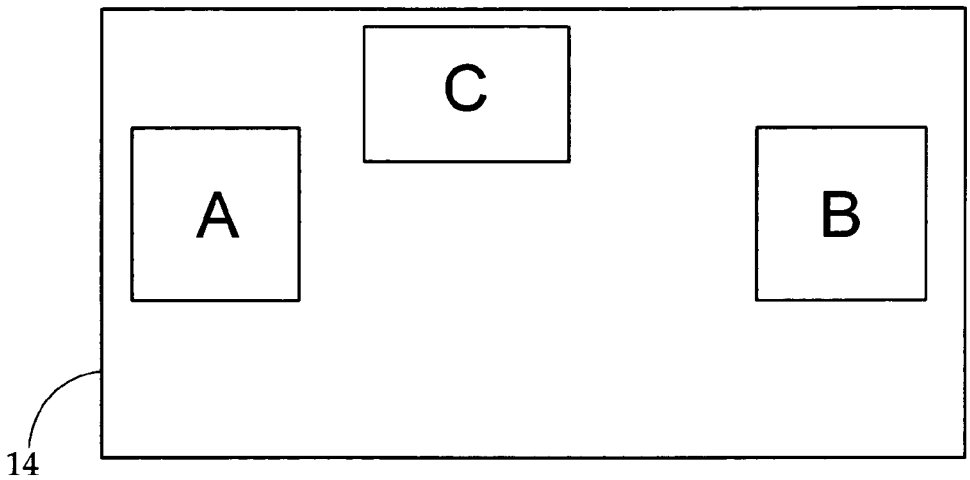
FIG. 4 is a top view of a box spring of a typical bed illustrating the locations where the therapeutic mattress support wedges could be positioned depending upon the desired portion of the body to be elevated.

FIG. 4 is a top view of the box spring 14 illustrating the various positions in which the therapeutic mattress supports or wedges 20 could be oriented. In position A, the therapeutic mattress supports or wedges would be positioned proximate the head of the box spring and beneath the mattress so as to provide the desired degree of support, elevation and comfort to the head, neck, and upper torso of the individual reclining on the mattress.

In position B, the therapeutic mattress supports or wedges 20 would be positioned proximate the foot of the bed to provide the desired degree of support, comfort and elevation to the lower legs. The position B orientation may also be moved towards the head of the box spring in order to provide the desired degree of support, comfort and elevation to the knees of the user.

In position C, the therapeutic mattress supports or wedges 20 would be positioned so as to impart an elevation to the edge of the mattress so as to prevent an individual from inadvertently rolling out of the bed or alternatively to provide additional support to an individual who is required to recline on his or her side.

Figure 5:
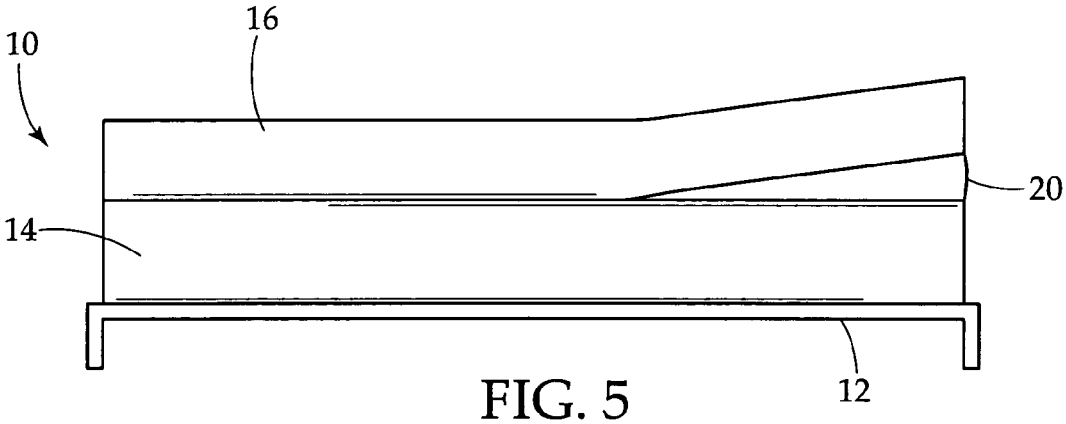
FIG. 5 is a side view of a box spring and mattress of a typical bed illustrating the positioning of the therapeutic mattress support wedges for support of the head and neck region in an elevated position.
Figure 6:
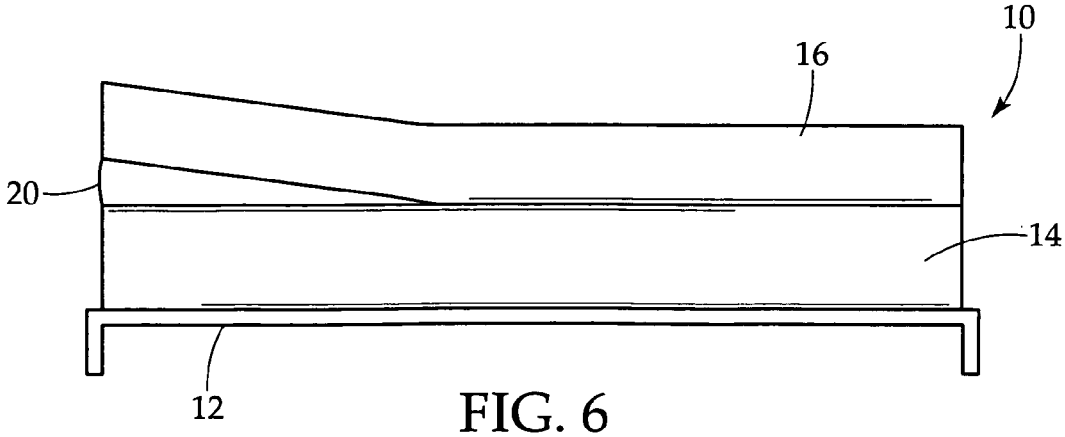
FIG. 6 is a side view of a bed of a box spring and mattress with the therapeutic mattress support wedges positioned for elevation of one or more of the lower extremities.

FIGS. 5 and 6 are side views of a box spring and mattress 14 and 16 of a typical bed 10 illustrating the positions of the therapeutic mattress supports or wedges 20 in support of the head or neck region (FIG. 5) or in support of the lower extremities (FIG. 6).

The therapeutic mattress supports or wedges 20 are easily positionable by lifting the mattress in the desired area where the user wishes to achieve elevation and positioning one or more of the therapeutic mattress supports or wedges at the desired location in order to achieve the desired height and concomitant support and pain relief. Due to their interlocking nature, the therapeutic mattress supports or wedges 20 will not shift of move with respect to each other, and the weight of the mattress plus that portion of the individual's body reclining on the mattress above the therapeutic mattress supports or wedges 20 will prevent the therapeutic mattress supports or wedges 20 from shifting between the mattress 16 and the box spring 14.

As an option, the therapeutic mattress supports or wedges may be formed with a handle or gripping means 50 on one or both of the tapered triangular side walls, or the vertical end wall to facilitate the positioning and removal of the therapeutic mattress supports or wedges from between the box spring 14 and the mattress 16.

Therefore, while the present invention has been disclosed with respect to the preferred embodiments thereof, it will be recognized by those of ordinary skill in the art that various changes and modifications can be made without departing from the spirit and scope of the invention. It is therefore manifestly intended that the invention be limited only by the claims and the equivalence thereof.

We claim:

1. A therapeutic mattress support selectively positionable between a mattress and a box spring, said therapeutic mattress support being rigidly wedge-shaped having triangular lateral sides, a bottom flat surface and an upper angled surface, said bottom flat surface and said upper angled surface having a plurality of complementary protrusions and depressions which permit multiple therapeutic supports to be interlocked, lower surface to said adjacent upper surface, thereby allowing the selective elevation of a portion of said therapeutic mattress from said box spring to provide the desired angled degree of support, comfort and relief to a portion of a body from pain.

2. The therapeutic mattress support in accordance with claim 1 wherein said wedge-shape of said therapeutic mattress support forms an acute angle.

3. The therapeutic mattress support in accordance with claim 1 wherein said therapeutic mattress support is formed of one piece molded plastic having a plurality of geometric projections on its upper and lower surface, said geometric projections and protrusions of said upper surface cooperable with said geometric projections and protrusions on an adjacent lower surface therapeutic mattress support so as to interlock said adjacent therapeutic mattress supports allowing for the adjustment in height and angle of a portion of said therapeutic mattress to provide the angled degree of support to a portion of a human body.

4. The therapeutic mattress support in accordance with claim 1 wherein said therapeutic mattress supports may be interlocked and positioned at a head end of a mattress for support of the head, neck and upper torso, the foot end of a mattress for height and support of the leg or lower extremities, and on the lateral sides of the mattress for torso and hip support.

* * * * *